United States Patent [19]

Batoni

[11] 4,352,343

[45] Oct. 5, 1982

[54] CONSTRUCTIONAL IMPROVEMENTS IN A TWO-STROKE OPPOSED PISTON ENGINE OPERATING WITH STRATIFIED CHARGE

[75] Inventor: Giovanni Batoni, Pontedera, Italy

[73] Assignee: Piaggio & C. S.p.A., Genoa, Italy

[21] Appl. No.: 171,235

[22] Filed: Jul. 21, 1980

[30] Foreign Application Priority Data

Nov. 27, 1979 [IT] Italy ..... 27599 A/79

[51] Int. Cl.[3] ..... F02B 25/12

[52] U.S. Cl. ..... 123/51 BA; 123/73 AE; 123/73 A

[58] Field of Search ..... 123/51 R, 51 BA, 51 B, 123/73 R, 73 A, 73 AE

[56] References Cited

U.S. PATENT DOCUMENTS

| | | | |
|---|---|---|---|
| 2,768,616 | 10/1956 | Venediger | 123/51 BB |
| 2,886,018 | 5/1959 | Cuddon-Fletcher | 123/51 BA |
| 3,411,289 | 11/1968 | Antonsen et al. | 123/51 BA |
| 3,923,019 | 12/1975 | Yamada | 123/73 R |
| 4,090,479 | 5/1978 | Kaye | 123/51 BA |

*Primary Examiner*—Craig R. Feinberg

*Attorney, Agent, or Firm*—Cushman, Darby & Cushman

[57] ABSTRACT

The invention relates to an improvement in a two-stroke internal combustion engine with opposed cylinders of different diameters which communicate by way of a combustion chamber of bell configuration for radially stratifying the rich mixture charge fed tangentially into the minor cylinder and the air charge fed into the major cylinder.

2 Claims, 4 Drawing Figures

CONSTRUCTIONAL IMPROVEMENTS IN A TWO-STROKE OPPOSED PISTON ENGINE OPERATING WITH STRATIFIED CHARGE

The present invention relates to a constructional improvement in a two-stroke engine of the type comprising opposed pistons running in coaxial cylinders of different bore fed separately, by means of their own crankcase-pumps, with scavenging air or dilute combustible mixture, or with rich combustible mixture, with the object of improving the engine performance in terms of the specific fuel consumption and the atmospheric pollution produced by the exhaust gas, but without prejudicing the specific power.

Engines of the aforesaid type have been known for some time, but are not widespread, probably because the expected improvements have not been obtained or because of excessive manufacturing cost. An engine of this type has recently been proposed in which a combustion chamber is provided constituted by a central part of spherical shape communicating directly with the cylinder fed with rich mixture, said cylinder having a bore of smaller diameter than the bore of said spherical chamber, and communicating with the cylinder of greater bore (main cylinder) fed with air on dilute mixture through a suitably restricted short passage.

In this engine, the essential characteristics are considered to be the spherical shape of said chamber, the ratio of the volumes of the combustion spaces relative to the spherical chamber to those relative to the adjacent cylinders, and the ratio of the cross-section of said chamber to that of said restricted passage.

The spherical shape has been justified by the supposition that during the charge compression stage, it favours the formation therein of a vortex of toric shape caused by the stream of rich mixture flowing from the cylinder of smaller bore, and of scavenging air flowing in the opposite direction from the restricted central passage which communicates with the other cylinder. The effect of the vortex would be to increase the combustion speed of the still relatively rich mixture which would form in said chamber where the ignition sparking plugs are disposed.

Besides participating in the formation of the spherical chamber and in the formation of said vortex, restricting the passage cross-section between said chamber and the main cylinder would also have the effect of hindering the diffusion of the scavenging air towards the spherical chamber during the scavenging stage, thus utilising the air essentially for aiding the outflow of the exhaust gas from the exhaust port, and simultaneously hindering the diffusion of the rich mixture into the main cylinder and its escape towards the exhaust port, consequently increasing fuel consumption and the amount of unburnt hydrocarbons in the exhaust.

At the end of compression, there would be a stratified charge of richer combustible mixture in the spherical chamber in the space remaining in the smaller cylinder, and of dilute mixture in the space remaining in the main cylinder, with a consequent increased possibility of attaining complete fuel combustion. In reality, this engine has shown a low content of unburnt gas in the exhaust, but also the defect of having a low specific power.

The object of the present invention is to considerably reduce said drawback while at the same time maintaining or further reducing the loss of fresh mixture to the exhaust, and thus the specific fuel consumption and the HC and CO content of the exhaust, this having been shown to be attained experimentally.

This object is attained according to the invention by a two-stroke engine with opposed pistons moving in cylinders of different bore, which are each fed separately by a relative crankcase-pump, the cylinder of smaller bore being fed with richer fuel-air mixture, and the cylinder of greater bore being fed with less rich mixture, the two cylinders communicating to form a combustion chamber, wherein the two cylinders are connected by a bell-shaped portion constituting the combustion chamber, and the transfer ducts for the richer mixture open into the cylinder of smaller bore tangentially at its lateral wall.

The invention can be better understood with the aid of the figures of the accompanying drawing.

Figure 1:
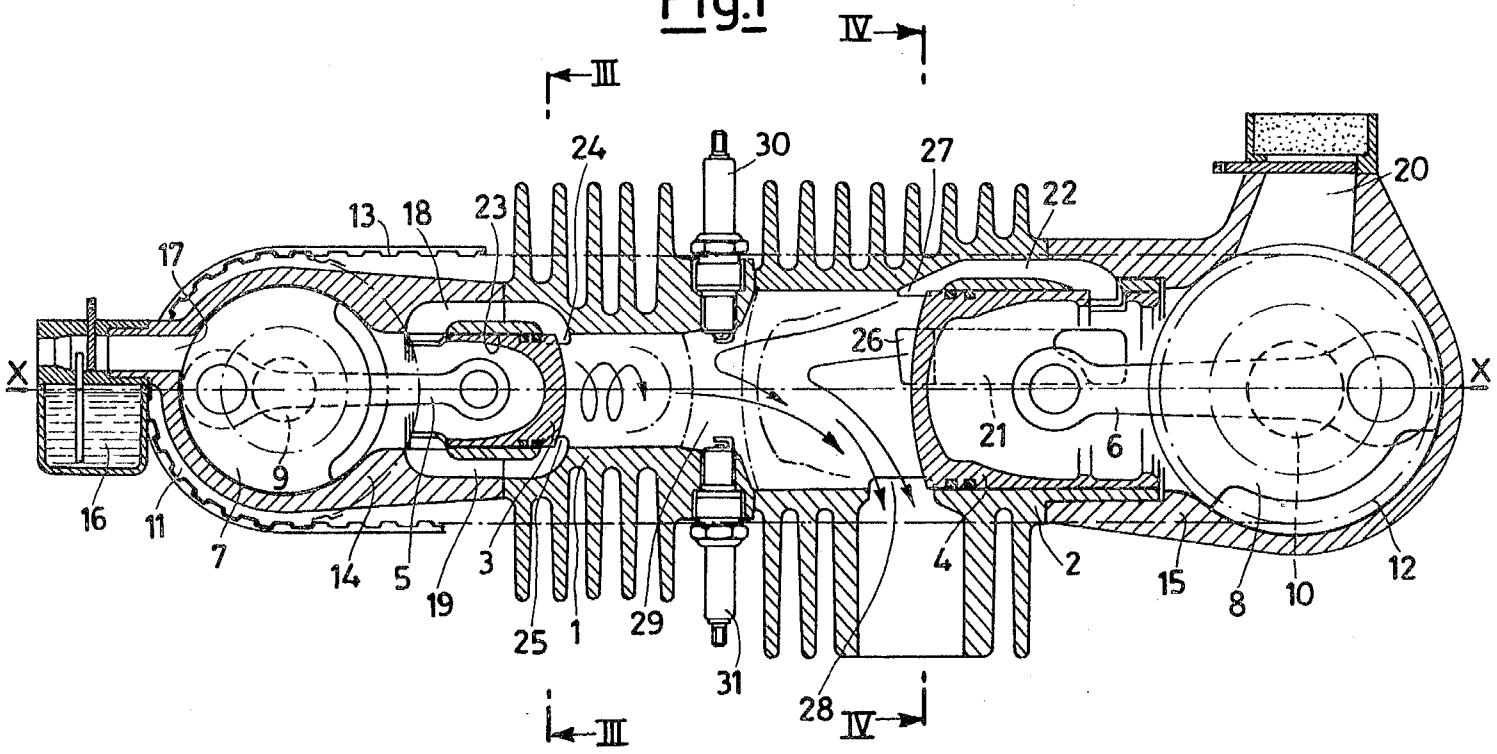
FIG. 1 is a diagrammatic general cross-section through an engine according to the invention, taken on a plane passing through the cylinder axis and normal to the crankshafts of a two-stroke engine with opposed pistons in two cylinders of different bore.

As can be seen in FIG. 1, the engine comprises the cylinders 1 and 2, the first (feeder) being of smaller bore than the second (main), but having the same axis x—x, and in which the pistons 3 and 4 slide respectively. The pistons are connected by connecting rods 5 and 6 to the cranks 7 and 8 of the driveshafts 9 and 10, which are connected together by the belt transmission indicated diagrammatically by the pitch circles 11 and 12 of the relative pulleys, and by the centre line 13 of the belt.

The driveshafts 9 and 10 are contained in the crankcase-pumps 14 and 15.

The engine is fed with a rich fuel-air mixture by way of the carburettor 16, the induction port 17, the crankcase-pump 14 and the transfer ducts 18 and 19, and with a weak mixture or with air by way of the induction duct 20, the crankcase 15 and the transfer duct or ducts 21 and 22.

Figure 3:
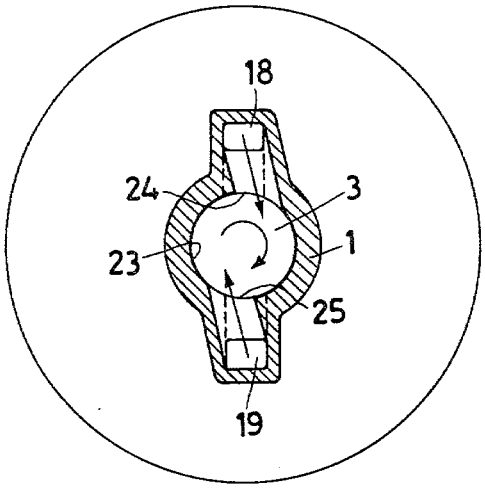
FIG. 3 is a cross-section through the engine normal to the axis of the cylinders taken on the plane III—III of FIG. 1, passing through the transfer ports of the cylinder of smaller diameter.

The transfer ducts 18 and 19 open tangentially at the inner surface 23 of the cylinder 1 of smaller bore by way of diametrically opposite ports 24 and 25 as shown in FIG. 3, in such a manner as to impress a rotary motion about the axis x—x on the rich mixture during transfer.

Figure 4:
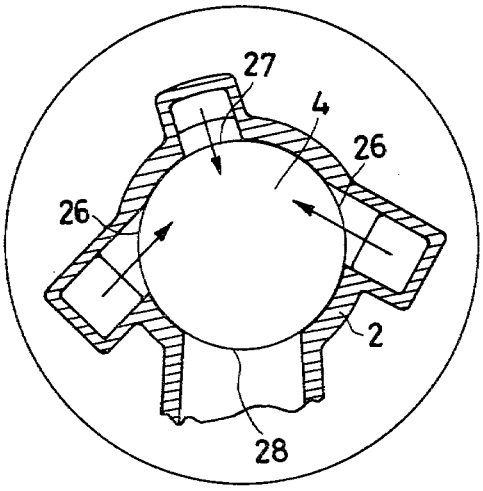
FIG. 4 is a cross-section through a cylinder on the plane IV—IV of FIG. 1, passing through the relative transfer port.

The air transfer ducts 21 and 22 open into the cylinder of greater bore by way of ports 26 and 27 disposed approximately on one end and the other side of the exhaust port 28 as shown in FIG. 4, in order to produce a Schnurle-type scavenging.

Figure 2:
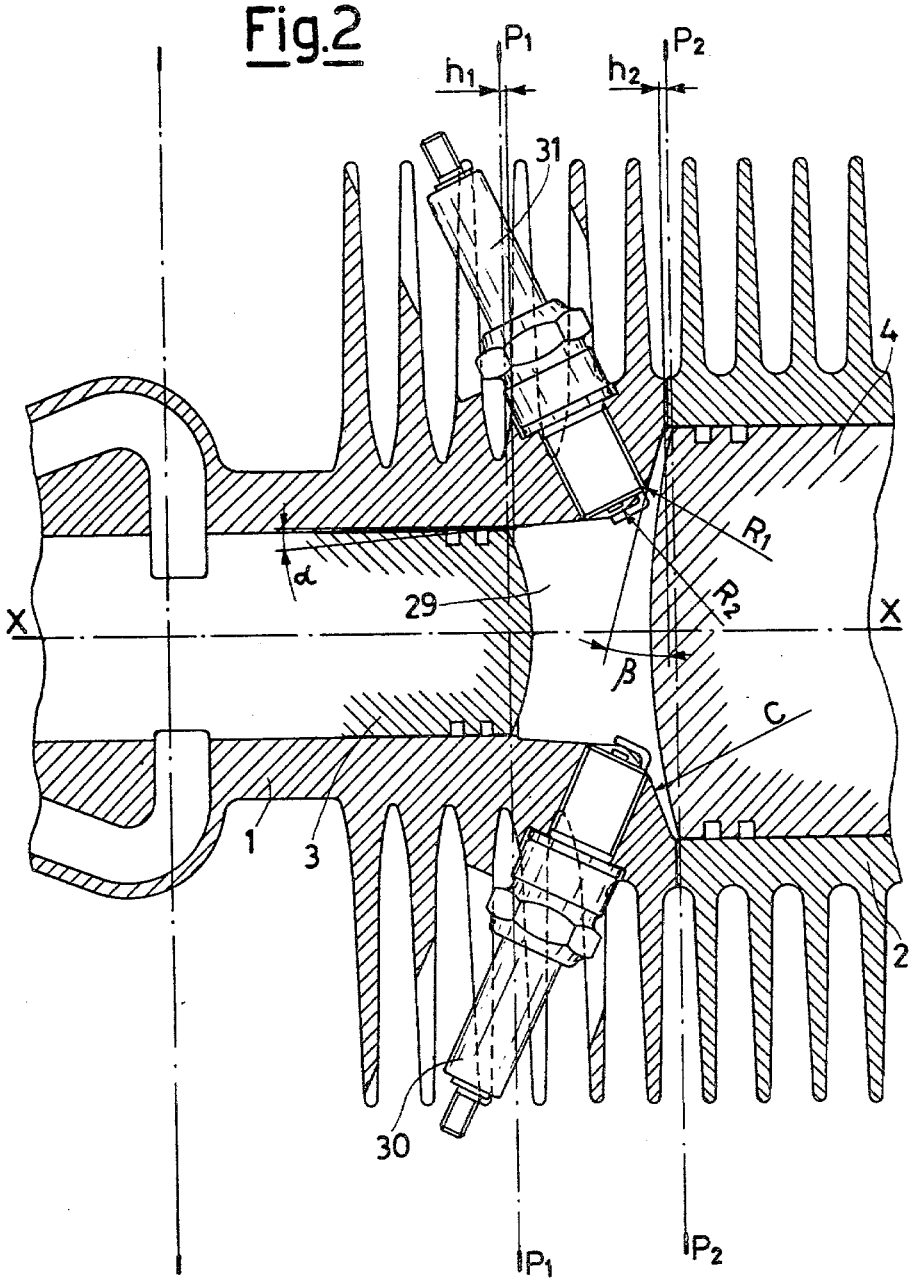
FIG. 2 is an enlarged cross-section through a common cylinder combustion chamber of a modification of the engine of FIG. 1, the pistons being at their minimum distance apart.

As can be seen in FIG. 2, the cylinders 1 and 2 are connected together by a curve (c) which is designed such as to give the combustion chamber 29, lying between the planes $P_1$—$P_1$ and $P_2$—$P_2$ normal to said cylinders, a characteristic bell shaped defined by the angles $\alpha$ and $\beta$ of inclination of the tangents at the ends of said curve to the cylinder axis x—x and to the plane $P_2$—$P_2$ respectively, this latter being normal thereto, and by the radii $R_1$ and $R_2$.

The lateral surface of the combustion chamber is completed by the cylindrical surfaces lying between said planes $P_1$—$P_1$ and the heads of the pistons 3 and 4. The height of these surfaces can vary from zero if the pistons simultaneously reach their top dead centre, to values indicated by $h_1$, $h_2$, which are still very small, if the pistons do not operate in phase. Generally, it is advantageous for the piston 3 to lag behind the piston 4.

In this case, as shown in FIG. 2, the piston 3 has not yet reached its top dead centre, being distant therefrom by a length $h_1$, whereas the piston 4 has already begun its return stroke to the extent of a distance $h_2$.

The ignition sparking plugs 30 and 31 are disposed diametrically opposite each other in the combustion chamber 29. The operation of the engine during the scavenging stage is as follows: as the piston 4 moves towards its bottom dead centre, it uncovers the exhaust port 28, to enable the exhaust gas which has expanded in the cylinders 1 and 2 to leave. A moment later, the piston 4 uncovers the transfer ports 26 and 27 to enable the air precompressed by the piston in the crankcase 15 to enter the cylinders and to thrust the remaining exhaust gas towards the exhaust port 28.

Simultaneously, the piston 3 also descends towards its bottom dead centre to uncover the transfer ports 24 and 25, from which the rich mixture, previously precompressed by the piston 3 in the crankcase 14, enters the cylinder 1 with rotary motion. This constributes to the evacuation of the exhaust gas contained in the cylinder 2.

The piston 4 then rises towards its top dead centre to close the exhaust port 28 and then the transfer ports 26 and 27. Either a moment later or simultaneously, the piston 3, which also rises, closes the transfer ports 24 and 25.

The compression stage for the gas remaining in the cylinders then begins, and the intake stage for the rich mixture and air or weak mixture into the crankcase 14 and 15 also begins.

The vortex of rich mixture fed into the cylinder 1, and lying along the axis x—x, is thrust by the piston 3 into the combustion chamber 29, while the piston 4 thrusts the scavenging air remaining in the cylinder 2 into the same chamber. A radial stratification of compressed mixture with different percentage contents of fuel thus becomes created in the combustion chamber 29.

The richer mixture, which can burn more rapidly, collects by centrifugal force further from the centre, in the neighbourhood of the sparking plug electrodes, while air with a smaller fuel content together with that small amount of unburnt gas which was not able to pass in time from the exhaust port remains at the centre.

This mixture can also burn because of the temperature increase produced by the richer mixture, and therefore contributes to the work of expansion.

The ratio of air weight to petrol weight can thus be maintained overall at a greater value than the stoichiometric combustion value (dilute mixture).

The advantages of the said shape of the combustion chamber together with the tangential arrangement of the relative transfer ducts at the feed cylinder and the provision of more than one ignition sparking plug in an engine of the type according to the invention are apparent from the aforegoing explanation.

The optimum value of the ratio of the bore of the feed cylinder to the bore of the main cylinder is $\frac{1}{2}$, but this can vary according to the dimensions of the engine and of other structural elements.

With regard to the values of the angles $\alpha$ and $\beta$ and the radii $R_1$ and $R_2$ of the combustion chamber, these must be such as to keep the rich mixture stream adhering to the walls during compression, while ensuring an ample connection arrangement between the cylinders compatible with an appropriate volume of the combustion chamber.

I claim:

1. A two-stroke engine with opposed pistons moving in cylinders of different before having a common axis, which are each fed separately by a relative crankcase-pump, the cylinder of smaller bore being fed with richer fuel-air mixture, and the cylinder of greater bore being fed with less rich mixture, the two cylinders communicating to form a combustion chamber, wherein the two cylinders are connected by a bell-shaped portion constituting the combustion chamber, and transfer ducts for the richer mixture open into the cylinder of smaller bore tangentially at its lateral wall, wherein the lateral wall surface of said combustion chamber is a surface of revolution, having a generating curve which is formed substantially by arcs of a circle which are tangential to each other, said generating curve being inclined to the axis by an angle of about 3°–7° at that end which connects to the smaller bore cylinder forming a first surface whereas this angle is about 70°–80° at that end which connects to the other cylinder forming a second surface, wherein at least one spark plug is located substantially at a junction of the first and second surfaces.

2. An engine as claimed in claim 1, wherein a ratio of a diameter of a cross-section of one end of the chamber and a diameter of a cross-section of an opposite end lies between 1.5 and 3.

* * * * *